United States Patent [19]

Salazar

[11] 4,239,176

[45] Dec. 16, 1980

[54] CONCRETE CONSTRUCTION SYSTEM

[76] Inventor: Rafael D. Salazar, 6425 SW. 96th St., Miami, Fla. 33156

[21] Appl. No.: 910,860

[22] Filed: May 30, 1978

[51] Int. Cl.[3] ..... B22D 19/04; B41B 11/58

[52] U.S. Cl. ..... 249/97; 249/44; 249/45; 249/47; 249/85; 249/160; 249/168; 249/192

[58] Field of Search ..... 249/97, 96, 26, 33, 249/34, 38, 85, 101, 130, 131, 132, 139, 142, 149, 160, 168, 192, 196, 48, 189, 191, 44, 45, 47

[56] References Cited

U.S. PATENT DOCUMENTS

| | | | |
|---|---|---|---|
| 1,032,674 | 7/1912 | Holland | 249/48 |
| 1,154,998 | 9/1915 | Meyer | 249/48 |
| 1,381,823 | 6/1921 | Griffin | 249/99 |
| 1,516,760 | 11/1924 | Callaghan | 249/193 |
| 1,756,542 | 4/1930 | Dowd | 249/49 |
| 2,845,685 | 8/1958 | Lovgren et al. | 249/192 |
| 2,975,498 | 3/1961 | Plattner | 249/139 |
| 3,123,887 | 3/1964 | Boettner | 249/192 |
| 3,291,437 | 12/1966 | Bowden et al. | 249/48 |

*Primary Examiner*—Donald J. Arnold
*Attorney, Agent, or Firm*—Robert F. Ziems

[57] ABSTRACT

A concrete construction system and method for erecting building structures in which column casting molds are assembled from a plurality of modular, interlocking, reusable forming elements, and in which the precast columns are provided with anchoring elements embedded in one end of the column. Support footings are cast in situ using reusable form components to provide a structure accommodating direct placement of precast support columns and precast wall panels. A framework of adjustable joist assemblies provides support for construction of the roof or upper level floor structure.

8 Claims, 15 Drawing Figures

CONCRETE CONSTRUCTION SYSTEM

BACKGROUND OF THE INVENTION

The present invention relates to the construction of reinforced concrete building structures, and more particularly, to concrete construction systems and method of using prefabricated modular components and formed-on-site components.

Conventionally, reinforced concrete construction has required the building of forms for almost all of the components of the structure on the construction site, pouring of concrete and removal of forms after the concrete has set. This is expensive and inefficient since the form for each building component has to be individually fabricated, subsequently dismantled and then fabricated again for the next building level or for the next use. While the concrete is curing, expensive equipment is idle, and further progress on the building cannot be made.

The use of precast and standardized components offers advantages in terms of reduced cost and increased efficiency. However, there are limitations relating to the transportation and handling of precast components, and the construction of a complete structure using only precast components may not be readily achieved.

SUMMARY OF THE INVENTION

Accordingly, a general object of the invention is to provide an improved method and system of concrete building construction combining the best features of using both prefabricated and formed-on-site components.

Another object of the invention is to provide reusable column casting forms assembled from a plurality of modular elements for casting columns to be used in a building, the columns having an integrally formed anchoring element provided at one end.

Another object of the invention is to provide modular, reusable form elements used in the formation on-site of a wall support footing which is particularly adapted for use with prefabricated structural columns having integrally-formed anchoring elements.

Other objects of the invention include: the provision of a unique system and construction method for forming the roof structure or the upper floor structure for a concrete building; a method of construction using precast support columns provided with integral anchoring elements and precast wall panels used in conjunction with such columns; and a method of construction using precast support columns having integral anchoring elements, precast wall panels, and formed-on-site wall structure support footing provided with means for receiving the support column anchoring elements and wall panels.

These and other objects of the invention are attained, in one aspect of the invention, by providing modular, interlocking reusable forming elements which may be assembled into a mold for casting concrete support columns used in the construction of buildings, the columns having anchoring elements embedded in one end to position and to support the columns. Modular, reusable forming elements are assembled into a form for the pouring of a support footing for wall structures, including molds for forming the cavity in the footing to receive the anchoring elements of the prefabricated support columns. Modular, reusable elements are attached to the upper portions of the precast support columns and wall panels to support a plurality of reusable, adjustable joist elements for the fabrication of a roof or the upper level floors of a building.

In accordance with another aspect of the invention, a technique for the construction of a building structure utilizing prefabricated standardized components and formation-on-site of the support footing for the walls, involves the use of modular, reusable footing-forming elements assembled for the pouring of the wall footing, the use of reusable mold elements for forming the cavities in the footing to receive the anchoring elements embedded in the prefabricated support columns, and the techniques and steps involved in the erection of a concrete building utilizing such precast support columns with integrally-provided anchoring elements, precast wall panels disposed between and supported by such columns, and the use of reusable, modular adjustable joist elements for the formation of the roof and/or upper floors.

DETAILED DESCRIPTION OF THE PREFERRED EMBODIMENTS

Figure 1:
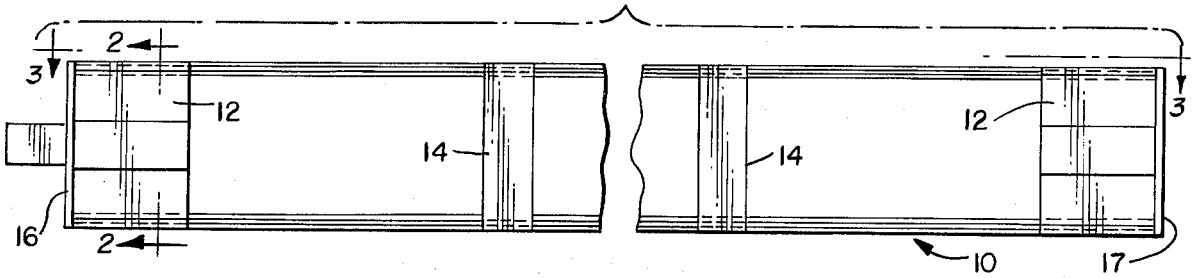
FIG. 1 is a top view of a column casting mold assembled from a plurality of modular mold elements of the present invention.

In FIG. 1 of the drawings, a four-sided column casting mold, generally designated by the reference numeral 10, is assembled from a number of reusable, interlocking, modular forming elements, each of which is of a predetermined length such that the cast column is a standard length, such as a length sufficient to form the nominal eight-foot high building levels. One side of the mold 10 is open, and each end portion of the open side is stablized by an end plate 12, and the sides of the mold are braced by bracing element 14 spaced along the length of the mold. The end plates 12 and the bracing elements 14 may conveniently be assembled from convenient lengths of the modular elements which form the sides of the mold. The open ends of the column 10 are closed and squared by end caps 16 and 17.

A suitable molding material, such as concrete, is poured into the mold 10 through the spaces between the bracing elements 14 while the mold is on a vibrating table, or before the mold is placed on a vibrating table. The exposed surface of the concrete may be finished in a conventional manner, after the concrete has been settled on the vibrating table, as is known in the art, after which the column may be set aside to permit the concrete to cure conventionally or by using speed-up curing techniques. While not specifically shown in FIG. 1, it is understood that reinforcing elements, such as rebars or steel rods, would be properly positioned within the mold prior to the pouring of the concrete.

It is understood that more than one column mold would be used at any given time, and a plurality of the filled molds would be placed on a vibrating table. After the concrete has properly cured, the mold elements may be disassembled, the cast column removed, and the mold reassembled for use in casting other columns. Fabrication of the columns in the foregoing matter may be achieved at or near the construction site, or preferably at a production facility.

Figure 2:
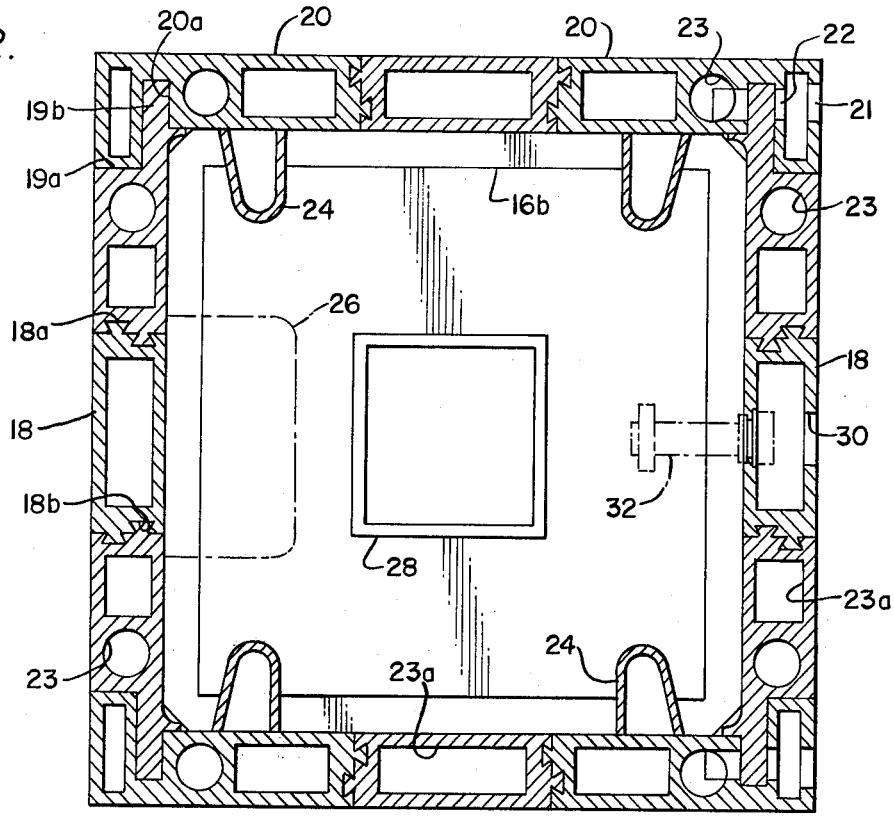
FIG. 2 is a cross-sectional view of the column casting mold as seen along line 2—2 of FIG. 1.

Each of the modular interlocking elements which is assembled to form the mold 10 may be a substantially hollow structure of rectangular cross-section, as shown in FIG. 2, extruded, for example, from aluminum, with the edges of each element provided with suitable interlocking means. For example, modular element 18, which may conveniently form the intermediate element in one side of the mold 10, has its edges provided with dovetail-like ribs 18*a* and channels 18*b* which cooperate with similar interlocking means on the adjacent modular element to provide a sliding, interlocking attachment.

Modular element 19 is illustrative of an element used at the corner of the mold 10. The edge of the element 19 opposite from the edge provided with the dovetail-like interlocking means has a recessed portion 19*a* forming a tongue-like extension 19*b* adjacent to the inner surface of the element. Another modular corner element 20, which cooperates with the element 19, has the edge opposite from that provided with the dovetail-like interlocking elements provided with a channel 20*a* spaced away from the free end of the element, which receives the tongue-like extension 19*b* of the element 19. The tongue, or rib 19*b* since it extends the length of the element 19, and the channel 20*a* behave as a tongue-and-groove joint to permit the easy assembly of the corner elements 19 and 20 to form the mold 10.

Figure 3:
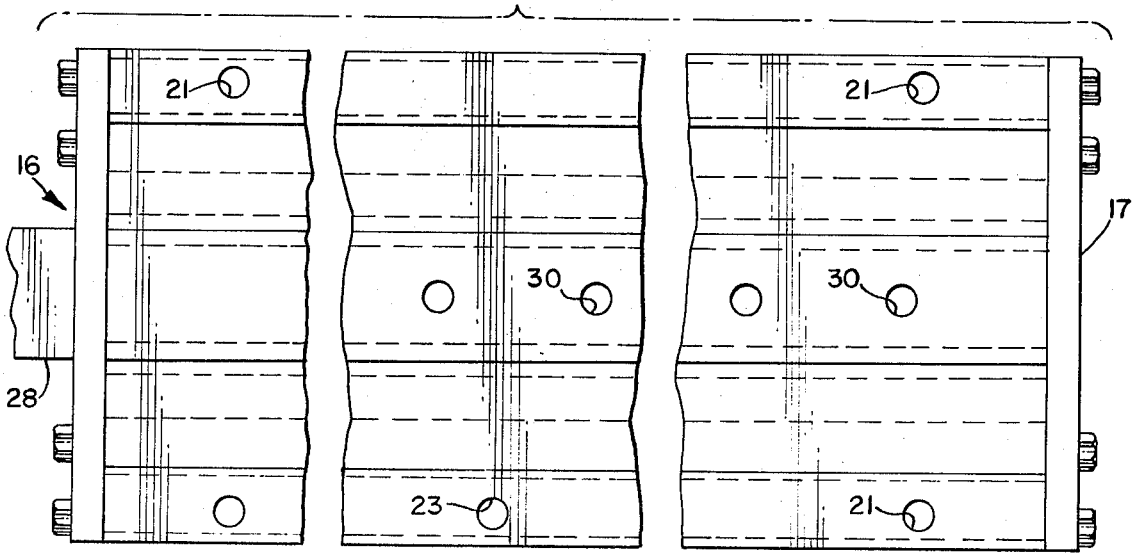
FIG. 3 is a side view of a portion of the mold as seen along line 3—3 in FIG. 1.

As shown on the right side of FIG. 2 and in FIG. 3, each of the corner modular elements 20 is provided adjacent the end portion of its length with holes 21 which permit the insertion of suitable features 22 through the tongue-like extension 19*b* for the removable attachment of the corner modular elements 19 and 20. Each of the modular elements is provided with one or more lightening holes 23, 23*a* to reduce weight. The circular lightening hole 23 in each of the corner elements 19 and 20 is provided at each end of its length with threaded inserts (not shown) which receive suitable fasteners for the attachment of the end caps 16 and 17.

Longitudinally-extending inserts 24 of an appropriate cross-section are suitably attached to the inside surface of the column mold 10 to form recessed channels in the cast column for receiving the vertical edges of the precast wall panels supported by the columns, as will be described more fully below. Receptacle inserts 26 (shown in phantom in FIG. 2) are suitably attached to the inside surface of the mold 10, such as to the inside surface of the intermediate modular element 18, to form recesses in the cast column which receive electrical fixture boxes for switches and plugs. The inserts 26 may be positioned at any appropriate location along the length of the column, and on any side of the column as required.

A substantially square anchor tube 28, which is initially supported by the end cap 16, extends a predetermined distance into the mold 10 at the end of the column which will be the foot of the column, i.e., the left end of FIG. 1. The anchor tube 28 becomes embedded on the cast column and is used to position and to anchor the foot of the column during the erection of the building, as will be described more fully below.

As seen in FIGS. 2 and 3 of the drawings, the central exterior surface of one of the intermediate modular elements 18 is provided with a series of apertures 30 at spaced intervals along the length, to provide access for the positioning of threaded anchor inserts 32 at appropriate locations on the column which will receive threaded fasteners during the erection of the building, such as shoring and bracing elements, and the adjustable joist elements which support the framework for the construction of the roof or upper level floors. This will be described in detail below.

Figure 4A:
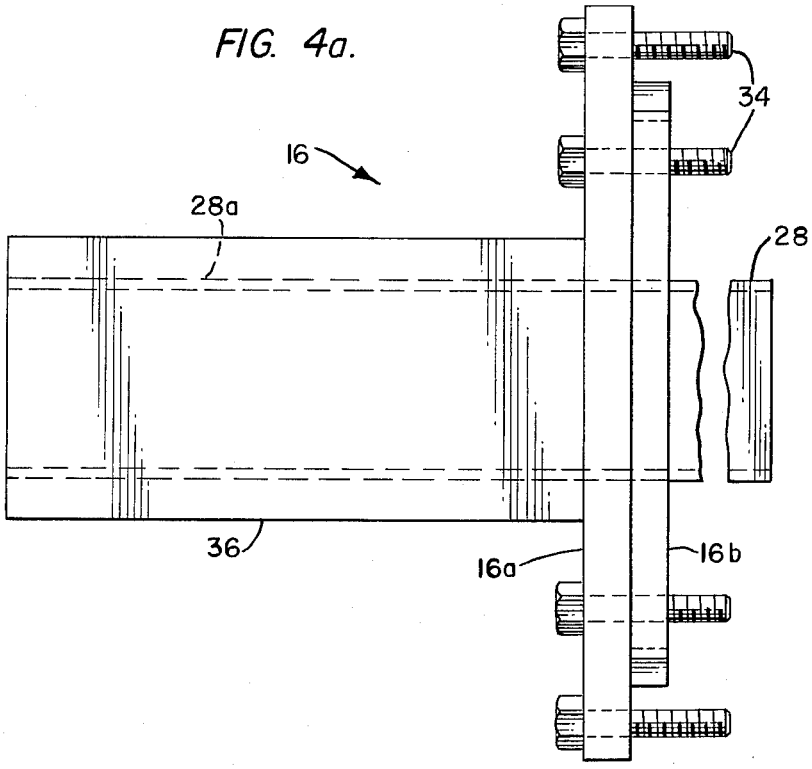
FIGS. 4*a* and 4*b* are elevational views of the end caps secured to the ends of the column casting mold of FIG. 1.
Figure 4B:
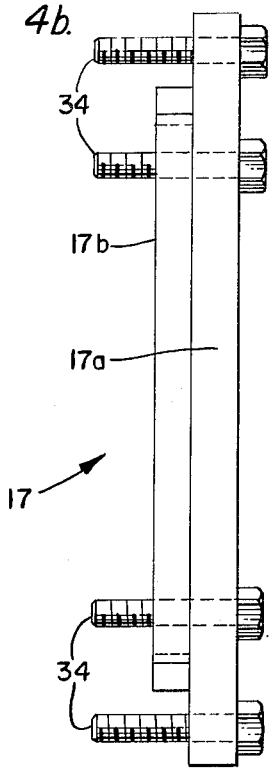

With reference to FIGS. 4*a* and 4*b*, the end cap 16 is of a substantially square configuration having an outer plate 16*a* of the same size as the cross-section of the assembled column mold 10. When assembled, the outer plate 16*a* abuts the end portions of the assembled modular elements forming the mold 10. A second, inner plate 16*b* fits within the inner perimeter of the assembled mold 10, and both plates 16*a*, 16*b* are securely attached to the end of the mold by fasteners 34 passing through holes provided in the plates and cooperating with the threaded inserts disposed at the end portions of the circular lightening holes 23 provided in the corner modular elements 19 and 20, as noted above. Fixedly attached to and extending from the exterior surface of the outer plate 16*a* is a shell 36 which receives and positions the anchor tube 28. The plates 16*a* and 16*b* are provided with openings through which the anchor tube 28 may pass.

The structure of the end plate 17 which closes the end of the mold 10 forming the upper end of the cast column is substantially the same as end plate 16, except that there are no provisions made for the insertion therethrough of an anchor tube. However, openings are provided in the plates 17*a* and 17*b* for the passage of mechanical and electrical equipment, i.e., pipes, conduits, ducts, etc. The end plates 16 and 17 are removed after the column has cured, and the anchor tube 28 remains partially embedded within the lower portion of the cast column.

Figure 5:
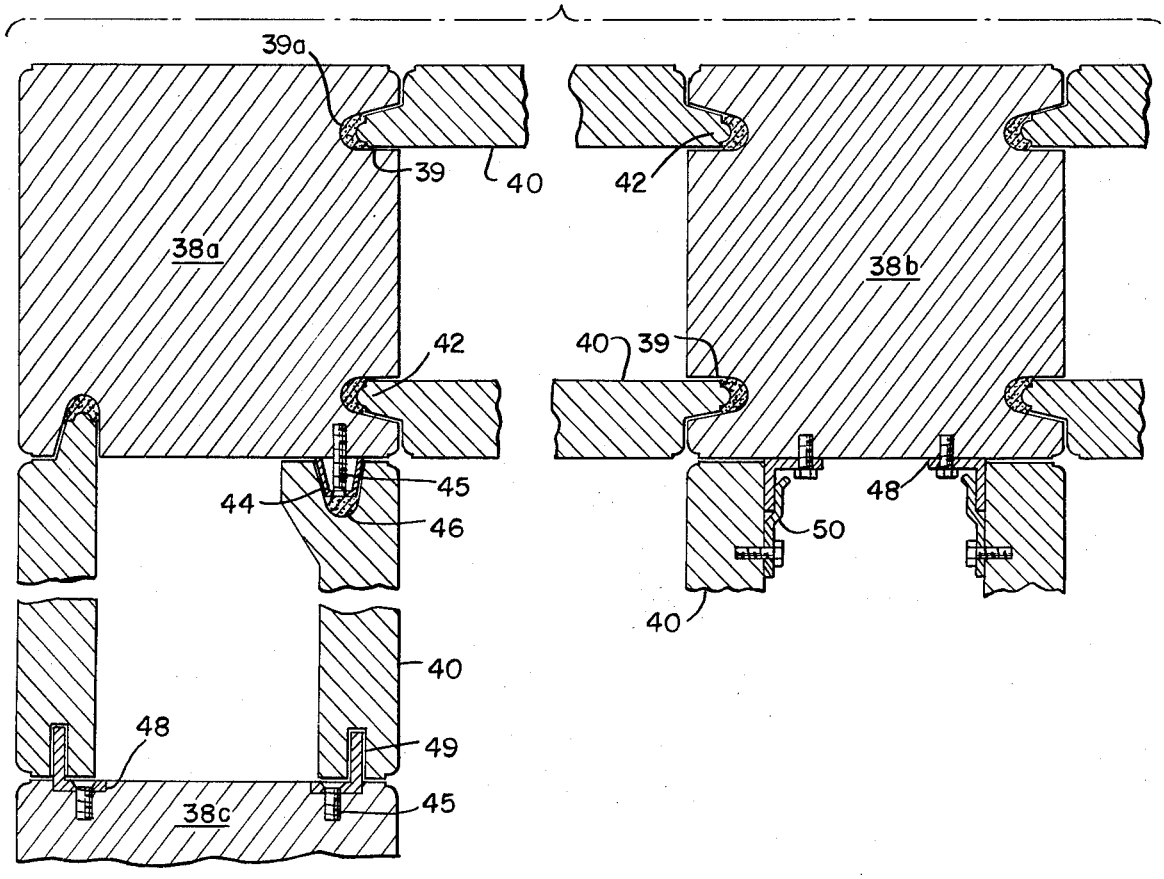
FIG. 5 shows the cross-sectional shape of different column configurations which can be cast with the mold of FIG. 1, and the wall panels disposed between the columns.

Shown in FIG. 5 are cross-sections of different column configurations which may be cast with the mold 10 shown in FIG. 1 by the use of the proper inserts to form the wall-receiving channels. For example, column 38*a* is a corner column provided on two adjacent surfaces with wall panel receiving channels 39, and which would normally be positioned at a corner position of a building. Column 38*b* is a T-type column which is positioned at an intermediate point along the exterior wall, and which also provides support for the interior wall panels, and accordingly is provided on three surfaces with wall panel-receiving channels. Similarly, column 38*c* is an intermediate column which is not required to support interior wall panels, and accordingly, has panel-receiving channels on two opposite parallel sides. The channel 39 is deeper than the rib 42 to provide a groove 39*a* to receive grouting, sealant, adhesive or similar material used in the assembly of the wall panel to the supporting columns 38.

Also shown in FIG. 5 are alternative means for attaching the wall panels 40 to the columns 38. For example, trapezoidal-shaped male keyway inserts 44 may be attached to the sides of the column by fasteners 45 which are received in threaded inserts embedded in the columns, such as the inserts 32 described above. Instead of projecting ribs, the vertical edges of the wall panel have keyway insert-receiving channels 46, which may be similar in cross-sectional shape as the channels 39 formed in the cast columns 38. The sides of the keyway insert 44 are provided with holes (not shown) for the passage of grouting into the keyway channel 46. Alternatively, angle members 48 may be attached to the columns 38 by fasteners 45 received in threaded inserts. The free leg of the angle members 48 may be slidably received within recessed channels or grooves 49 provided on the vertical edges of the wall panels 40, as shown in conjunction with the intermediate column 38*c*, or may be slidably received within a clip member or clip strip 50 attached to the wall panels, as shown in conjunction with the intermediate column 38*b*.

It should be noted that not all the types of wall attachment means shown in FIG. 5 are necessarily used in a single installation, but are merely indicative of the types available. Also, the illustrated attachment means between hollow wall sections formed by the two spaced parallel-disposed wall panels 40 and the supporting columns 38 may also be used to attach and support interior partition wall panels. It is understood that the channels 46, 49 are formed in the vertical edges of the wall panels during panel fabrication. In this connection, the hollow wall structure formed by the use of two parallel-disposed and spaced wall panels would provide a space for the passage of mechanical and electrical equipment, for the installation of insulation, or similar requirements. If there is no need for interior space between wall panels, a single solid wall panel may be used. In either case, the wall panels will be provided with appropriate openings for equipment such as electrical plugs and light switches, etc.

Each of the wall panels 40 may be prefabricated as a single unit of a suitable width spanning the distance between adjacent support columns, and of an appropriate height which would normally extend from floor to ceiling of one level of a building. Alternatively, each of the wall panels may be fabricated of a length extending between adjacent supporting columns, but may be of a nominal height such that a plurality of these shorter panels would be superimposed vertically to form the necessary wall height. This latter concept offers the advantage of easier handling during fabrication, shipment and use of the prefabricated wall panels.

The wall panels may be prefabricated with any technique, such as automated production techniques, and be fabricated of welded wire fabric with fiberglass and/or acrylic polymer materials which produce suitable panels of controlled thickness.

Figure 6:
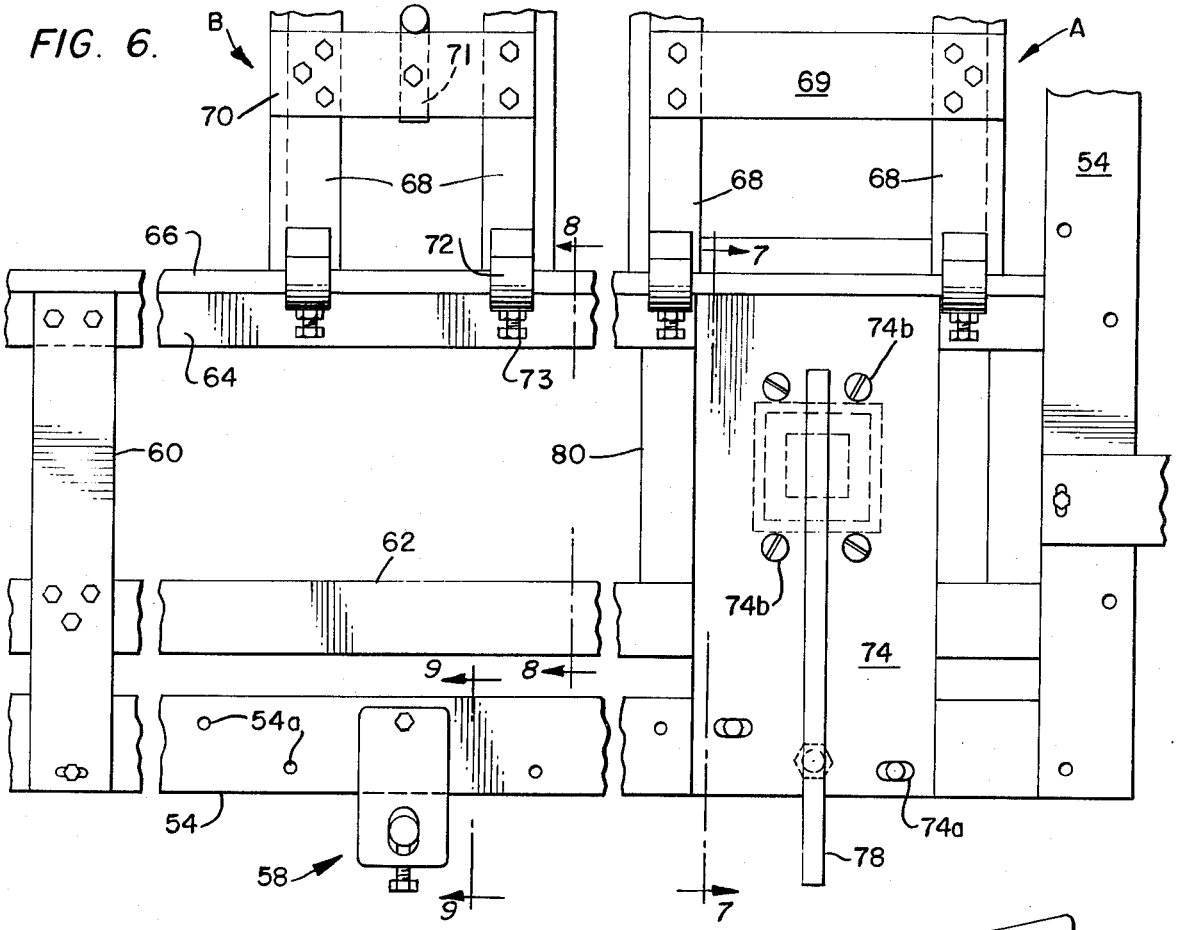
FIG. 6 is a plan view showing various form components assembled for the pouring of a portion of wall support footings and the foundation in the construction of a building.

Shown in FIG. 6 are a number of elements assembled for the pouring of the wall-supporting footing around the perimeter of a foundation floor and the supporting footing for an interior wall. A number of modular, reusable and standardized perimeter form elements 52 are assembled and positioned to define the outer perimeter of the perimeter footing. Each of the form elements 52 has a C-shaped cross-section with parallel-disposed upper flange 54 and lower flange 55 joined by a vertically extending web 56. The upper flange 54 has two parallel rows of spaced holes 54*a*, while the lower flange 55 has a single row of holes with each of the holes being provided with threaded receivers to receive suitable fasteners for purposes which will be described below. The web 56 may be of any convenient nominal height such as 4-, 6-, 10-inches, and individual form elements 52 may be stacked for increased height if necessary. Each of the form elements 52 is reinforced along its length with ribs 57, with a reinforcing rib positioned at the ends of the element. The reinforcing ribs at the ends are provided with vertically spaced holes and protruding elements which align with corresponding holes in the adjoining form elements to permit easy assembly of the individual modular form elements 52 to form the desired length, or to form 90° bends, as is shown in the right side of FIG. 6. A stake assembly 58 is attached to the flanges of the perimeter form elements 52 at spaced intervals to align, position and anchor the elements.

Figure 8:
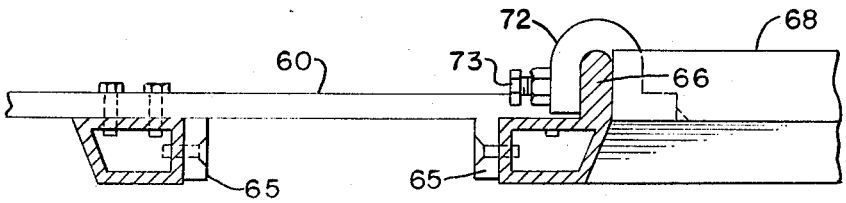
FIG. 8 is a view as seen along line 8—8 of FIG. 6 with some of the structure shown in section, of a portion of the assembled wall footing form.

A spacer bar 60 is attached at one end to the form element 52, and serves to position and align groove-forming members 62 and 64, which form the grooves in the wall support footing to receive the lower edges of the wall panels. The lower surface of the spacer bar 60 is provided with downwardly-extending support tabs 65 which engage and attach to the sides of the groove-forming element 62 and 64 (FIG. 8). The tabs 65 are properly spaced such that the grooves formed by the elements 62, 64 define the nominal, desired thickness of the formed wall structure.

Figure 7:
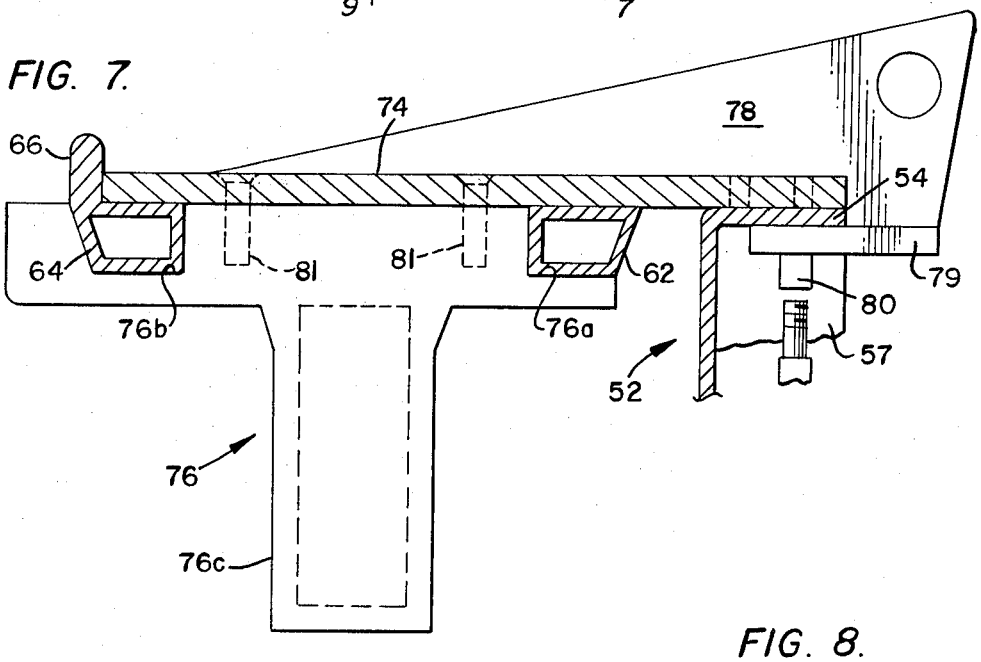
FIG. 7 is a side view, as seen along line 7—7 of FIG. 6, of a column anchoring cavity mold and associated holding plate bracket.

As can be seen from FIGS. 7 and 8, each of the groove-forming elements 62, 64 is substantially hollow in cross-sectional configuration. The element 64 is provided with an upstanding screed ridge 66 extending along the upper edge to provide a built-end screed guide for the finishing procedure of the poured concrete. The spacer bar 60 and the upper surfaces of the groove-forming elements 62, 64 are provided with alignable holes for the receipt of appropriate fasteners.

Shown at positions A and B in FIG. 6 are the groove-forming elements 68 which form the 90° exterior wall footing and an interior wall footing, respectively. The groove-forming elements 68 are properly spaced in parallel by the spacer-bracing members 69 and 70, respectively. The spacer-bracing member 69 may be structurally identical to the spacer bar 60, and while not specifically shown, may be attached at one end to the form element 52 while the spacer-bracing member 70 may be stabilized by a stake member 71 appropriately attached to the spacer. The ends of the groove-forming elements 68 are perpendicularly attached to the groove element 64 by an attachment member 72 welded or otherwise secured to the end portion of the groove element 68. The attachment member 72 may conveniently be of an inverted U-shaped cross-sectional configuration which readily slips over the screed guide 66 of the groove element 64, as shown in FIG. 8. An adjustable securing member 73 permits the ready attachment and removal of the attachment member 72.

A holding plate bracket 74 attaches at one end to the form element 52 and extends the distance between the groove elements 62, 64 to support and position a column anchoring cavity mold, or anchor mold, 76 which will form in the wall support footing the receiving cavity for the anchoring tube embedded in the foot of the cast column. In the illustration of FIG. 6, the bracket 74 and the anchoring mold 76 are disposed at the corner of the foundation perimeter, but it is understood that this assembly will be properly positioned wherever a support column is to be positioned.

The attachment end of the bracket 74 is provided with a pair of spaced slots 74*a* which aligns with the holes 54*a* in the form element 52 for the receipt of suitable attachment members and to permit minor alignment adjustment between the bracket and the form element. The other end of the bracket 74 is supported by the upper surface of the groove element 64, and abuts against the side of the screed guide 66. A set of four holes 74*b* extends through the bracket 74 and aligns with threaded inserts provided in the anchoring mold 76. A rib 78 of triangular side plan form extends substantially the length of the plate bracket 74 to reinforce and to support the bracket and also to facilitate removal of the bracket and the footing forms. As can be seen in FIG. 7, the rib 78 has a reentrant portion 79 which engages the underside of the upper flange 54 and has a cone screw 80 for more secure attachment of the bracket 74 to the form element 52.

The anchoring cavity mold 76 spans the distance between the groove elements 62, 64 and the end portions are provided with slots 76*a*, 76*b* which respectively receive the lower portions of the elements 62 and 64. The upper, central portion of the cavity mold 76 is provided with threaded inserts 81 which are alignable with the holes 74*b* in the bracket 74 to receive suitable fasteners which attach the mold to the bracket. A substantially rectangular, hollow pendant portion 76*c* of the mold 76 has an exterior configuration to form a cavity 82 (FIGS. 10 and 11) for receiving the anchoring tube 28 of the prefabricated column 38.

The anchoring cavity molds 76 are generally provided in six inch and eight inch square sizes with the eight inch size used for forming the cavity for columns forming the exterior walls or for inside walls when a nominal five and one-half inch hollow space is required for the wall panels. The six inch cavity mold is normally specified for inside walls. The molds may be cast in the illustrated shape from fiberglass and resinous materials.

Figure 9:
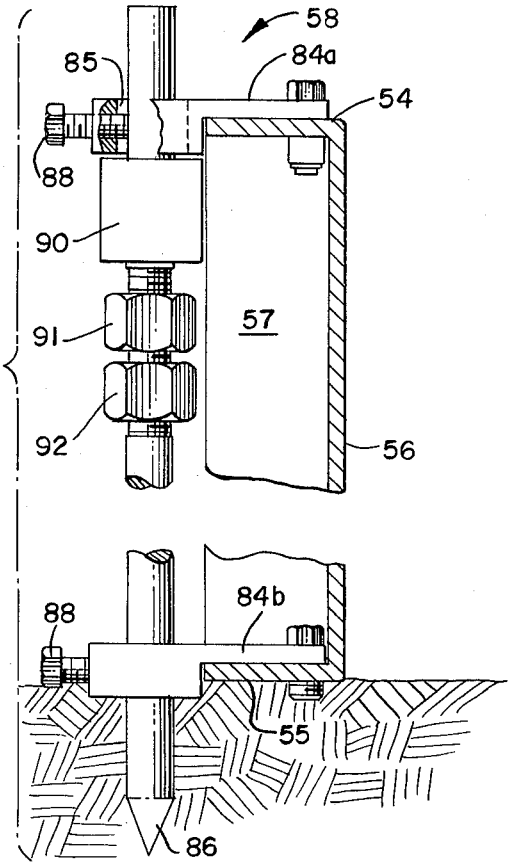
FIG. 9 is a view as seen along line 9—9 of FIG. 6, showing the wall footing form and stake assembly used in positioning and anchoring the form elements.

The structure of the stake assembly 58 used to position and to anchor each of the footing form elements 52 is shown more fully in FIG. 9 and includes spaced upper and lower plates 84*a* and 84*b*, respectively, each of which is perforated at one end to permit the passage of a suitable fastener to attach this end of the plate to the flanges of the form element. The other end of each plate 84*a*, 84*b* is provided with an elongated slot 85 through which a pointed stake 86 may be easily inserted. A lock bolt 88 extends from the free end of each of the plates 84*a*, 84*b* into the elongated slot 85, and engages the stake 86 to secure the stake to the plates. The mid-portion of the stake 86 is threaded to receive a spacer 90 disposed adjacent to the upper plate 84*a*, and a pair of adjustable lock nuts 91 and 92. The stake 86 may be conveniently fabricated from two sections of regular three-quarter inch diameter rods having a threaded end portion, with the threaded portions being welded together after the nuts 91 and 92 and the spacer 90 have been placed thereon.

In use, the upper and lower plates 84*a*, 84*b* are attached to the flanges 54 and 55 of the footing form element 52. The stake 85 is then inserted through the elongated slots 86, and the lock bolts adjusted to hold the stake securely in place after which the stake is driven into the ground to position and to anchor the form element 52. It should be noted that the stake 86 may be driven into the ground to properly position the form element 52 before it is locked by the bolts 88. In the event that the perimeter form at any location may require further levelling, the lock bolts 88 may be loosened and the adjacent nut 91 raised or lowered against the spacer 90 until the satisfactory level of the element is obtained. Then the lock bolts 88 are secured against the stake 86, and the lock nut 92 is brought into contact with the adjustment nut 91 to fix the stake assembly in the final adjusted level.

Figure 10:
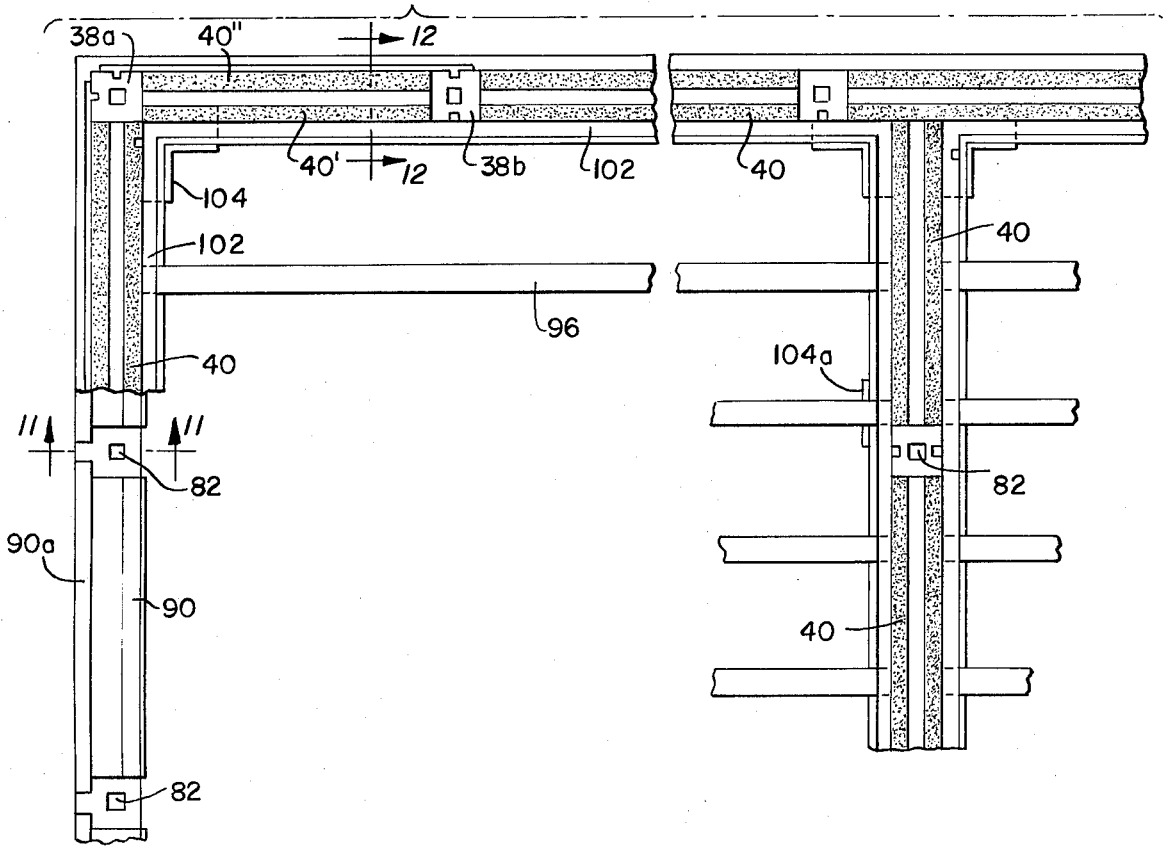
FIG. 10 is a plan view of one level of a structure built in accordance with the method of the present invention.
Figure 11:
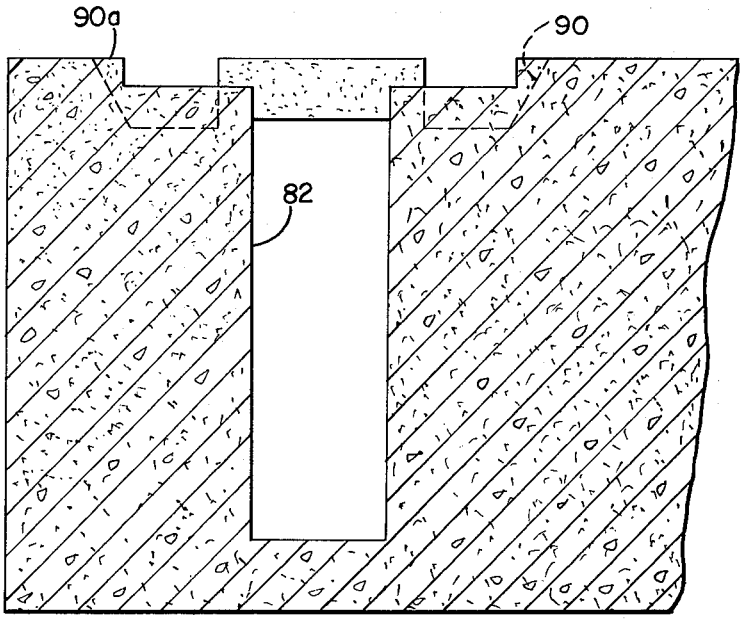
FIG. 11 is a sectional view as seen along line 11—11 of FIG. 10 showing a formed column anchor cavity in the wall footing.
Figure 12:
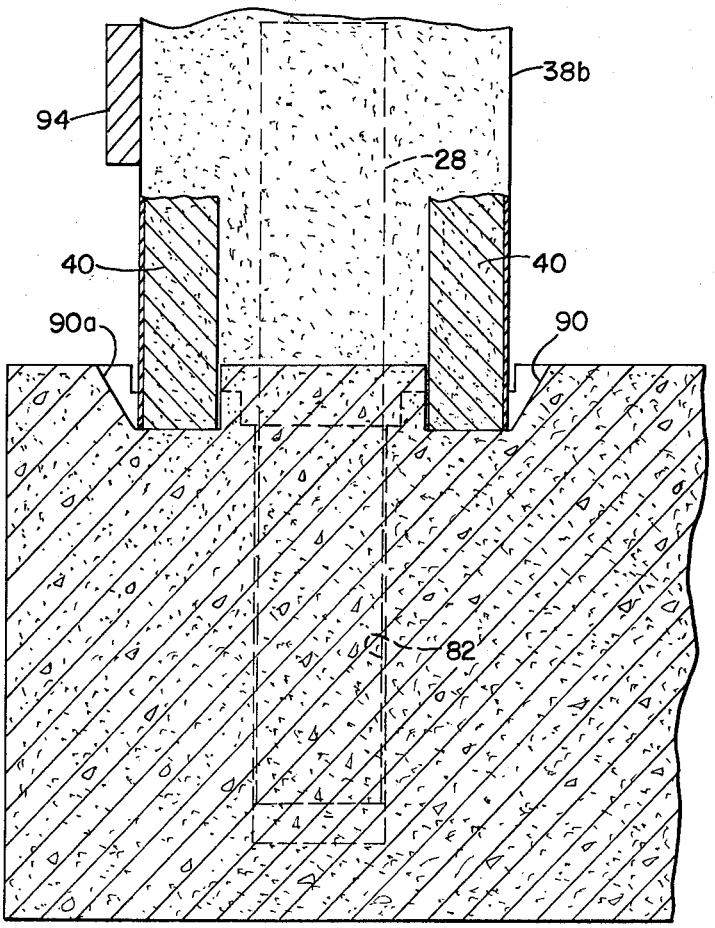
FIG. 12 is a view as seen along line 12—12 of FIG. 10, showing an installed column and wall panels.

FIG. 10 shows a portion of the perimeter wall support footing and an interior partition wall footing formed using the elements described above. Some of the columns 38*a*, 38*b* cast with the mold 10 described above are shown installed with the wall panels 40 disposed therebetween. The column anchoring cavities 82 are shown in the perimeter footing and the panel-receiving grooves 90, 90*a* are also visible in the perimeter footing, extending between the cavities 82. FIGS. 11 and 12 show more clearly the details of the cast column, such as column 38*b* with its embedded anchor tube 28 positioned in the cavity 82. The lower edge portions of the wall panels 40 are received within the grooves 90, 90*a* with the remaining space between the sides of the panel and the groove being subsequently filled with a suitable material such as grouting, adhesive, waterproofing, etc., during the finishing steps of the building construction. Also visible in FIG. 12 is a shoring element 94 which is used during the construction process to brace and to align the columns prior to their being securely anchored.

Figure 13:
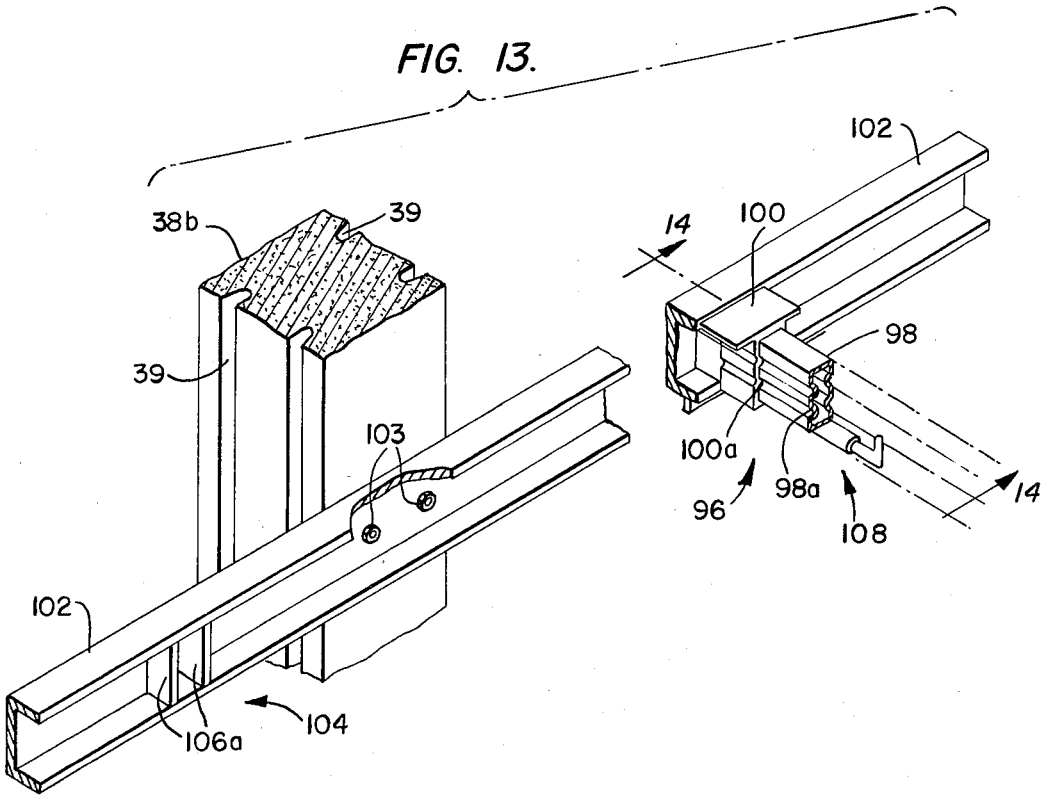
FIG. 13 is a perspective view of an adjustable joist assembly and support used in the construction of a floor or roof of a building structure.
Figure 14:
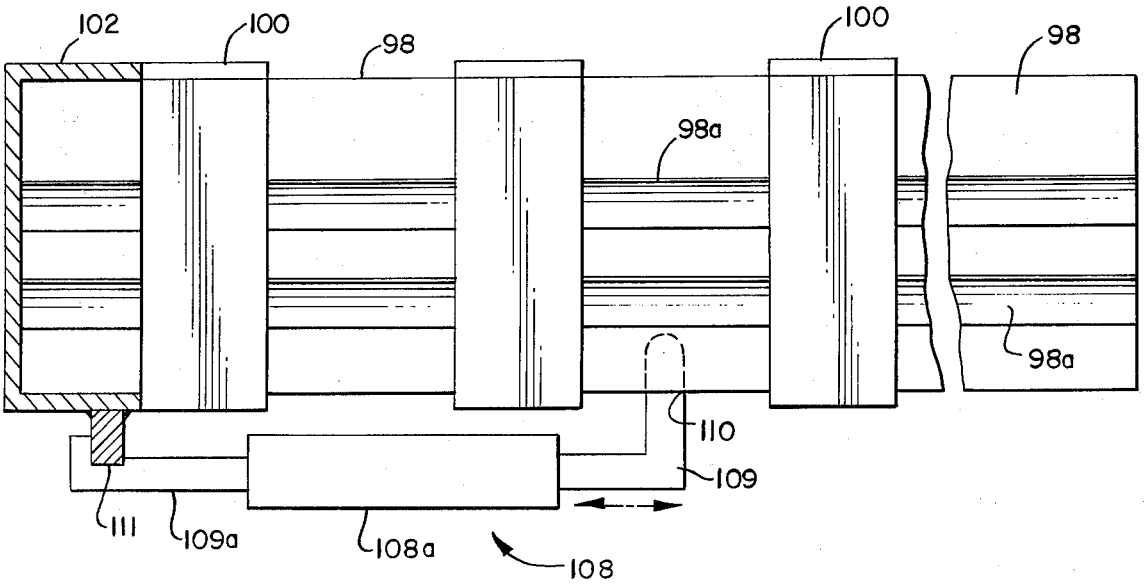
FIG. 14 is a sectional view along line 14—14 of FIG. 13.

Modular reusable adjustable joist elements which provide the supporting framework for the fabrication of the roof or the upper floor levels in the building are shown in FIGS. 10, 13 and 14. Each of the adjustable joist assemblies 96 may be telescopically adjusted to accommodate different lengths between the supports for the ends of the joist assembly and includes an inner joist member 98, the sides of which are provided with a number of recessed channels 98*a* and an outer interconnecting joist member 100 having a number of inwardly extending ridges 100*a* spaced along the vertical sides thereof. The interconnecting joist members 100 are of a short, suitable length, and are used to interconnect the ends of the standard length inner joist members 98, with the ridges 100*a* being received in the recessed channels 98*a* of the inner joist member to permit adjustable, sliding fit of the joist member 100 over the ends of adjacent inner joist members 98.

To support the free ends of the adjustable joist assemblies 96 a perimeter framework of support beams 102 is securely fastened to the upper portions of the columns 38 and the upper portions of the wall panels 40 supported by the columns. This is shown in plan form in FIG. 10. Each of the support beams, which may conveniently be of a C-shaped cross-section, is removably attached to the column or to the wall panels by fasteners 103 which are received within the threaded inserts 32 embedded in the cast column as described above relative to FIG. 2. The shape of the support beam and its attachment to the column 38 may be seen in FIG. 13. The ends of the support beams 102 which are adjacent to the corner of a structure may be supported by an angle plate 104 secured to the upper portion of a wall panel 40 or to the upper portion of a column 38, if such a column is conveniently located. The intermediate lengths of the support beam 102 may also be conveniently supported by a plate **104*a* suitably attached to the upper portion of the wall panel 40 or to a support column 38 as shown in FIG. 10. The support plates 104*a* provides a convenient means of supporting the free ends of adjacent, aligned lengths of support beams 102**.

As shown clearly in FIG. 13, a number of sockets or recesses 106 are spaced along the length of the support beam 102 to receive the free end of the adjustable joist assembly 96. Each of the sockets 106 is formed by two, parallel-spaced plates **106*a* welded or otherwise suitably attached to the inner surfaces of the C-shaped support beam 102. The spacing of the plates 106*a* is sufficient to provide a snug fit for the end of the joist assembly 98** which is inserted therein.

To facilitate the quick, convenient and secure insertion of the free end of the joist assembly 96 into the socket 106, a turnbuckle assembly 108 is provided at its ends with a hook element 109 and a notched arm element **109*a*. The hook element 109 has an upstanding portion which is received within a hole 110 drilled into the lower surface of the inner joist member 98, and the notch provided at the end of the notch arm element 109*a* engages a bar 111 welded to the under surface of the support beam 102, below the location of the socket 106. In this manner, it is apparent that rotation of the ratchet turnbuckle 108*a* in the proper direction will cause the arm members 109 and 108*a* to retract into the housing of the ratchet turnbuckle, causing the free end of the inner joist member 98 to be forced into the socket 106. After the inner joist member 98 is securely positioned within the socket 106, the turnbuckle assembly 108 is removed and the process is repeated for each of the free ends of the adjustable joist assemblies 96**. The process is reversed to remove the joist assemblies during disassembly of the framework.

An illustration of the coordinated sequence of steps involved in a construction technique for a concrete building which utilizes the systems components described above include substantially the following steps. The construction or erection unit may consist of a truck-mounted crane and one or more equipment trailers on which are disposed the prefabricated support columns 38, each with its embedded anchor tube 28, wall panels 40, components of the adjustable joist assemblies 96, the support beams 102 and other necessary components and equipment, all of which are arranged on the truck or trailer in an orderly manner, such that the components which were last loaded are the first ones unloaded. The erection unit may have a crew of five men, including the truck driver who will also operate the crane. Other laborers and jobbers will be on the job site as necessary.

The perimeter and interior wall footings with the anchor tube-receiving cavities 82 and the wall panel receiving grooves 90, **90*a* will have already been formed in the manner described above, and will be ready for the building construction. The construction begins at a pre-selected corner with a corner column, such as 38*a* in FIG. 10, being lowered into place with the anchor tube 28 being received within the cavity 82. This is shown, for example, in FIG. 12. When the column 38*a* is in place, the first interior wall panel 40' is slid into position; the exterior wall panel identified as 40'' in FIG. 10 is similarly positioned. Next, an intermediate column, such as column 38*b*, is lowered into place. The process is continued by the proper positioning of the wall panels 40', 40'' and the intermediate column 38*b* along the adjacent perimeter footing, which would be to the left in FIG. 10**. The positioning of the columns and the wall panels can be readily achieved by the crane operator with the assistance of two helpers.

Meanwhile, the other members of the crew are affixing bracing elements, such as 94 of FIG. 12, to the outside of the columns by means of threaded fasteners received in the threaded inserts 32 cast along the length of the column, as described above relative to FIG. 2. It is understood that when the columns are initially positioned, they may be approximately ⅛ inches out of alignment and the attachment of the bracing elements partially corrects this misalignment.

The foregoing sequence continues with the sequence of placing columns and the wall panels, attaching the bracing element and the installation of other components which may be called for in the plans, such as windows or door openings, open-space beams, etc., being repeated in one direction along the perimeter footing. When the first inside connecting wall is reached, the sequence of column-wall panel-column placement, etc., is repeated to the extent of the crane's reach. Afterwards, the construction sequence is turned to the other perimeter direction until the next inner connecting wall or the other outside wall is reached.

After sufficient progress has been made in the positioning and bracing of the support columns 38 and the wall panels 40, two members of the crew begins the next phase of construction on the inside of the structure by bolting at the upper portion of all inside corners the corner support plates 104 which support the free ends of the support beams 102 attached to intersecting walls. The support beams 102 are normally the same length as the entire length of the inside walls and are pre-drilled to exactly match the embedded inserts 32 located at the support columns' center lines. If the length of the support beams 102 does not match the length of the walls, the intermediate support plates **104*a* may be used. After the support beams 102 have been installed, the adjustment joist assemblies 96** are positioned in the manner described above.

All columns and wall panels should now be plumbed and aligned, and minor discrepancies corrected. The roof slab, if the building is single-level, is formed in a conventional manner with the support beams 102 and the adjustable joist assemblies 96 forming the support framework upon which a plywood platform is erected for the pouring of the roof slab, with the necessary reinforcing mesh. If additional levels are to be erected for the building, the floor for the next level is poured in the same manner as the formation of the foundation and its perimeter. It is understood that when the roof slab or the next floor level is properly cured then the support beams 102 and the adjustable joist assemblies 96 are removed for subsequent use.

The open space at the top of parallel wall panels can be covered with cover slabs which are precast in required widths and convenient lengths and provided with hoisting loops on its upper surface to facilitate handling and placement.

Because of the versatility of the extruded modular elements such as 18 and 19, it is possible to assemble these and similar elements into molds to precast doors and window frames in a multiple of configurations and dimensions. The door jams could be cast as an integral part of the column and the horizontal sections for the door openings may be separate untis which are subsequently attached appropriately. Provisions could be made within the jams for hinges and other hardware as required. Alternatively, the jams and horizontal sections of the door openings can also be cast as separated units to be attached to the columns after the columns have been positioned. When pre-hung doors or windows are specified, plain openings are provided in the wall panel. Open spaces in the building, such as a covered porch, recreation and family rooms, etc., which might not require walls, but require roof-supporting columns spaced at greater intervals, the modular elements 18 and 19 may be assembled to cast a support beam which would meet the necessary requirements of the length and depth to span the distance between the wider-spaced support columns.

The construction technique described above is particularly adapted for on-ground type floor construction in which the perimeter, interior and partition wall footings are integrally cast with the floor slab. In a structure having a basement, the basement walls will be erected in the conventional manner and the basement floor poured separately. Then, if the structure calls for a main concrete floor slab, the above procedure is followed, with the column anchor cavity molds inserted with the basement walls. However, if a wooden floor is specified, then only wall anchors are required and the basement walls are provided with anchorages for the floor's wooden joints.

If the building structure requires a crawl space, the above-described construction can still be utilized as far as the provision of the foundation perimeter and partition wall support footings. However, the height of the precast columns will be accordingly adjusted to the height requirements of a crawl space. Also, the nature and composition of the subsoil can restrict the use of the integral cast wall footings and floor slab, in which case the perimeter, interior and partition wall footings may be cast separately from the floor slab.

The broad techniques associated with the casting of the floor or roof slab can be used to form the roof overhang, a roof structure other than a flat slab, such as a sloping roof, etc., by use of the proper supporting elements attached to the upper portions of the columns 38 by means of the threaded inserts 35, as described relative to the support beams 102.

It is understood that the foregoing is an illustrative embodiment of the present invention, and that modifications and/or variations are contemplated without departing from the scope of the invention as defined in the appended claims.

I claim:

1. A mold assembly for forming pre-cast concrete structures, said mold assembly comprising:

a plurality of forming walls, each of said forming walls including a plurality of longitudinal extrusions adapted for releasable interlocking engagement to enable assembly and disassembly of each of said forming walls, at least one of said forming walls being a bottom wall to be supported on a horizontal surface, at least two of said forming walls being engaged with opposed parallel longitudinal sides of said one forming wall to define mold corners and at least a portion of one of said forming walls opposite said bottom wall being open to provide a pouring inlet;

a pair of end caps to close the mold at each end;

fastening means to secure said pair of end caps to said plurality of forming walls; and each of said extrusions being of generally rectangular cross-section and hollow to provide an outside wall, an inside wall and a pair of edge walls, the edge walls of at least two adjacent extrusions having complementing channel and ridge formations in interlocking relationship, and at said mold corners said extrusions having interlocking edges defined by a complementing tongue and groove connection whereby the mold may be assembled by interconnecting said extrusions in a manner to form a rigid structure suitable for receiving concrete poured through said pouring inlet.

2. The mold assembly recited in claim 1, wherein said extrusions at each of said mold corners further have cavity formations adjacent the end portion of its length and comprising mold-corner fastener means for removable insertion entirely within said cavity formations so that no portion of said fastener means protrude from the mold assembly.

3. The mold assembly recited in claim 1, wherein at least certain of said extrusions further include access means defining aperture formations through said outside wall and said inside wall to permit positioning threaded anchor inserts which become embedded within the pre-cast concrete structure.

4. The mold assembly recited in claim 1, wherein each of said pair of end caps comprises an inner plate received within the mold assembly and an outer plate abutting the mold extremities, and said extrusions at the mold corners further having circular cavity formations defined therein for receiving said fastening means to secure each of said pair of end caps to said forming walls.

5. The mold assembly of claim 1, further having at least one longitudinally-extending insert attached to the inside wall of selected ones of said extrusions to form a groove extending along the surface of said inside wall for receiving edges of a pre-cast concrete formation.

6. The mold assembly of claim 1, including recess means attached to the inside wall of at least one of said extrusions and positioned along the longitudinal surface of said inside wall to provide a suitable receptacle for electrical fixtures.

7. The mold assembly of claim 1, including stabilizing means spanning said pouring inlet between at least two of said forming walls to provide support for the mold assembly.

8. The mold assembly of claim 4, including opening means within said inner plate and said outer plate of one of said pair of end caps and having a shell attached to the outside plate of said one end cap to provide support for an anchor tube extending from within the mold assembly to the mold assembly exterior.

* * * * *